United States Patent [19]

Cook

[11] 4,325,547

[45] Apr. 20, 1982

[54] BACK STRENGTHENING DEVICE

[76] Inventor: Russell P. Cook, 58 Boulder Rd., Wellesley, Mass. 02181

[21] Appl. No.: 130,869

[22] Filed: Mar. 17, 1980

[51] Int. Cl.[3] ..... A63B 23/02

[52] U.S. Cl. ..... 272/144; 272/93; 128/75

[58] Field of Search ..... 272/61–63, 272/93, 109, 111, 112, 134, 144, 126, 70, 70.3, 70.4, 96; 128/25 R, 70–75

[56] References Cited

U.S. PATENT DOCUMENTS

| | | | |
|---|---|---|---|
| 2,865,367 | 12/1958 | Sorenson | 128/71 |
| 3,189,345 | 6/1965 | Simpson | 272/70.4 |
| 3,353,532 | 11/1967 | Ellis | 128/75 |
| 3,592,465 | 7/1971 | Fulkerson | 272/62 |
| 3,716,049 | 2/1973 | Kaplan | 128/75 |
| 3,847,146 | 11/1974 | Cushman | 128/75 |
| 3,888,243 | 6/1975 | Powlan | 128/75 |
| 3,911,907 | 10/1975 | Smith | 128/25 R X |
| 4,205,665 | 6/1980 | Burton | 128/75 X |

FOREIGN PATENT DOCUMENTS

| | | | |
|---|---|---|---|
| 364788 | 6/1906 | France | 128/75 |
| 829380 | 3/1938 | France | 128/75 |
| 1102005 | 4/1955 | France | 128/75 |
| 1371332 | 7/1964 | France | 128/75 |
| 858857 | 1/1961 | United Kingdom | 128/75 |

*Primary Examiner*—Richard J. Apley
*Attorney, Agent, or Firm*—Paul J. Cook

[57] ABSTRACT

In accordance with this invention, a back strengthening device is provided which includes a horizontal bar, a support for the horizontal bar and a foot platform which can be raised or lowered. Apparatus is provided on the horizontal bar to sense the application of hand grasping forces on the bar while the foot platform is provided with structure to sense weight being applied to the top surface of the platform. When the person desires to use the device, he grasps the horizontal bar to actuate the apparatus thereon while he is standing on the platform. These actions cause the platform to be lowered to a point just below contact with the feet or in mild contact with the feet as the force exerted on the platform is reduced while it is lowered away from contact with the weight of the user. The user then can hang from the horizontal bar so that all or substantially all of his weight is hanging free, thereby to stretch the back muscles. Upon completion of the exercise, the user releases the horizontal bar so that the feet contact the closely positioned platform with little or no force being exerted on the user thereby.

7 Claims, 5 Drawing Figures

BACK STRENGTHENING DEVICE

BACKGROUND OF THE INVENTION

This invention relates to a back strengthening device and more particularly to a device which permits a person to hang from a hortizontal bar while his feet are in very close proximity to or in contact with a foot platform.

Painful injuries to or malformations of the back are common human problems. Since these conditions are normally quite painful, the exercises necessary to strengthen the back muscles and thereby to assist in improving the malcondition are difficult, particularly those exercises which result in bending or twisting of the spine. Therefore, many patients cannot perform these exercises and, at best, are limited to exercises that are performed while the spine is straight. One such exercise is to hang from a horizontal bar so that the gravity force causes stretching of the back muscles which result in strengthening them particularly when such hanging exercises are performed routinely. While this exercise is desirable and is less painful than those involving bending or twisting of the spine, injuries sometimes result when the patient releases his hands from the bar and drops to the floor. This act requires a reasonable amount of strength and mobility and requires the patient to land on both feet simultaneously in order to avoid tipping of the pelvis which could inflict an injury to a weak back.

Accordingly, it would be desirable to provide a means for exercising the back which requires little or no bending or twisting to the spine. Furthermore, it would be desirable to provide such a means which does not require jumping or dropping to a flat surface or any other movement which could lead to bending or twisting of the spine which may result in injury.

SUMMARY OF THE INVENTION

In accordance with this invention, a back strengthening device is provided which includes a horizontal bar, means to support the horizontal bar and a foot platform which can be raised or lowered. Means are provided on the horizontal bar to sense the application of hand grasping forces on the bar while the foot platform is provided with means to sense weight being applied to the top surface of the platform. When the person desires to use the device, he grasps the horizontal bar to actuate the sensing means thereon while he is standing on the platform. These actions cause the platform to be lowered to a point just below contact with the feet or in mild contact with the feet as the force exerted on the platform is reduced while it is lowered away from contact with the weight of the user. The user then can hang from the horizontal bar so that all or substantially all of his weight is hanging free, thereby to stretch the back muscles. Upon completion of the exercise, the user releases the horizontal bar so that the feet contact the closely positioned platform with little or no force being exerted on the user thereby.

DESCRIPTION OF SPECIFIC EMBODIMENTS

The back stretching device of this invention is based upon the provision of actuating means on a horizontal bar or crutch support which supports the upper body of the user, which, in turn, cooperates with means associated with a foot platform to cause the platform to be raised or lowered to a desired point which is defined by the amount of weight of the user on the foot platform at the desired foot platform position. The actuating means can comprise switches or the like which energize means such as electrically, hydraulically, pneumatically or the like to raise or lower the foot platform. Conveniently, these means can comprise electrical switches or valves which activate flow of electricity or of a fluid. Preferably, such means are arranged in series so that movement of the platform is not activated unless all of the activating means have been in fact activated. Even more preferred, is to have separate activating means for each hand and the foot platform so that movement of the platform is not activated until the user has firmly grasped the bar and is on the platform for adequate support. If desired, the device of this invention also can be provided with means for raising the platform after being lowered thereby to provide increased support to the user while he is grasping the bar. Although, in this mode, the back will be exercised to a lesser degree, the user will be provided with increased safety.

The apparatus of this invention will now be described with reference to the accompanying drawings.

Figure 1:
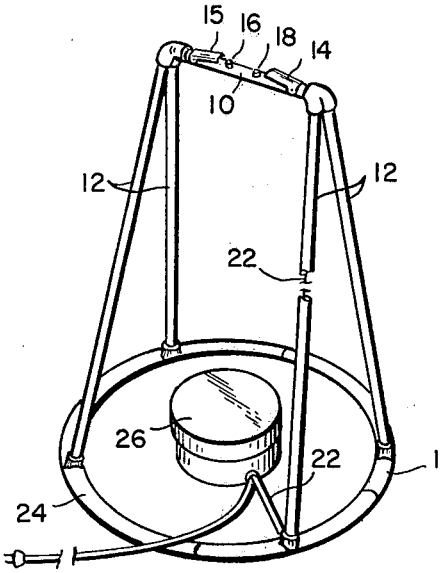
FIG. 1 is a perspective view, and partial cross-section of the device of this invention.
Figure 2:
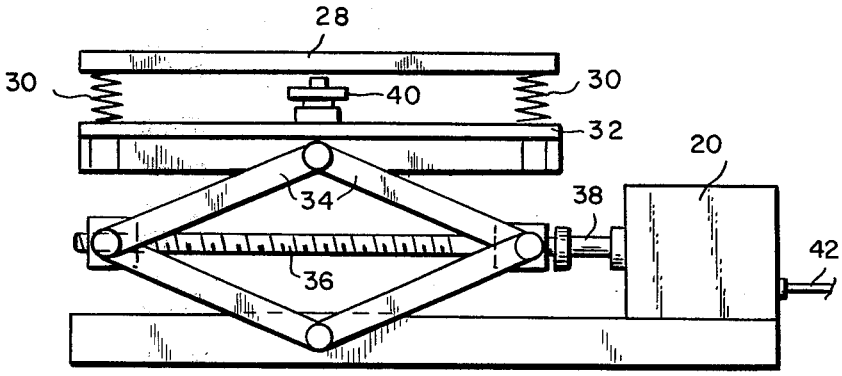
FIG. 2 is a side view of a suitable platform height-adjusting means.

Referring to FIG. 1, the back strengthening apparatus of this invention includes a horizontal bar 10 supported by legs 12 and is provided with spring-loaded hand grips 14 and 15 which are biased, during nonuse, away from contact with switches 16 and 18. Each switch 16 and 18 is electrically connected to an electric motor in the platform structure 26 by means of wires 22 which extend through the legs 12 and horizontal support 24. As shown in FIGS. 1 and 2, the platform structure 26 includes a platform 28 which is supported by springs 30 which, in turn, are supported on platform 32. Platform 32 is supported by jack 34 which raises or lowers platform 28 by means of a screw shaft 36 connected to shaft 38 of electrical motor 20.

In use, the apparatus of FIGS. 1 and 2 operates as follows. A person standing on the platform 28 compresses springs 30 and thereby activates switch 40. When switches 16 and 18 are activated by a person standing on platform device 26 who grasps hand grips 14 and 15, the electrical circuit to the motor 20 is completed. The electrical motor rotates screw shaft 36 and causes the platform to be lowered to a point just below which the force on platform 28 is insufficient to effect contact thereof with switch 40. This breaks the electrical circuit and inactivates motor 20. Similarly, when either hand grip 14 or 15 is released, the electrical circuit is broken and electric motor 20 is inactivated. When the person releases hand grips 14 and 15, the platform is in very close proximity with or touching the bottom of his feet and the person need not jump any significant distance upon completion of the exercise. Electric motor 20 can be provided with a manually operated electric switch 42 in order to raise the platform structure 26 to a desired height for subsequent use.

Figure 3:
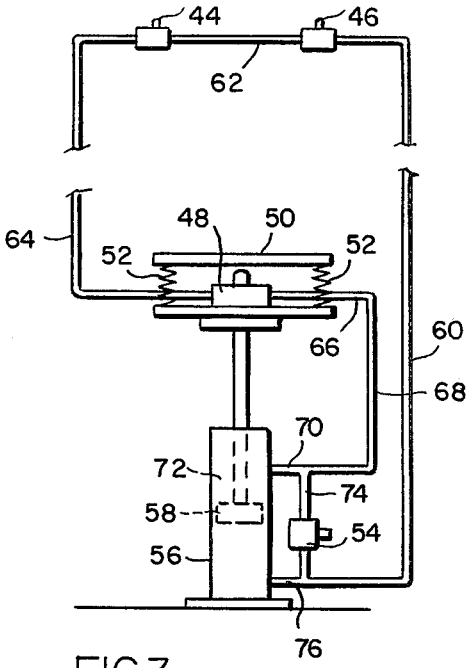
FIG. 3 is a side view of an alternative suitable platform height-adjusting means.

FIG. 3 shows an alternative embodiment of this invention which can be operated hydraulically. Valves 44 and 46 are activated by hand grips (not shown) and valve 48 is activated by contact with foot platform 50 which is supported on springs 52 substantially in the manner described above with references to FIGS. 1 and 2. When valves 44, 46 and 48 are open and release valve 54 is closed, thereby forcing liquid from the bottom portion 56 of cylinder 58 through pipe 60 which is within a leg (not shown), pipe 62 which is within the horizontal bar (not shown), conduit 64 which is within a leg (not shown) and conduits 66, 68 and 70 into the top portion 72 of cylinder 58. The platform 50 is lowered to a point at which the force on the platform 50 is insufficient to effect contact thereof with valve 48, which then closes to prevent flow of liquid into the top portion 72 of cylinder 58. Similarly, when hand grips are released to close either valves 44 or 46, flow of liquid ceases. After use of the device shown as completed, and valves 44, 46 and/or 48 are closed, bypass valve 54 is opened to permit pumping of liquid from upper cylinder portion 72 through conduits 70, 74 and 76 thereby to raise hydraulic piston 78, thereby to raise platform 50 to the desired position.

Figure 4:
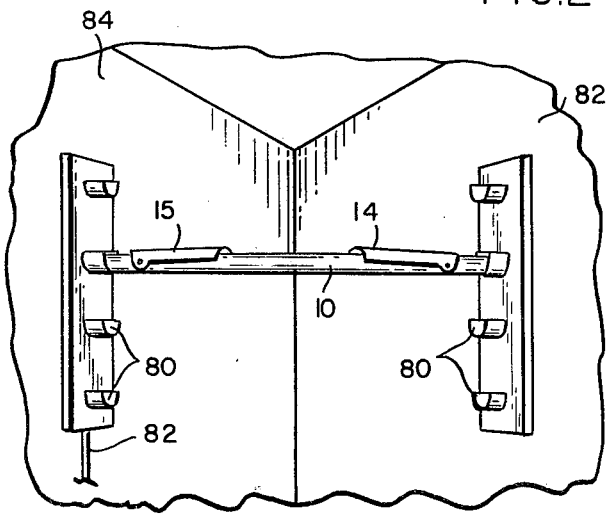
FIG. 4 shows an alternative means for supporting the horizontal bar.

Referring to FIG. 4, the horizontal bar 10 having hand grips 14 and 15 can be positioned within cups 80 of varying height which are supported by walls 82 and 84. The switches (not shown) within bar 10 are electrically connected by cord 82 to a platform device (not shown) which is described above.

Figure 5:
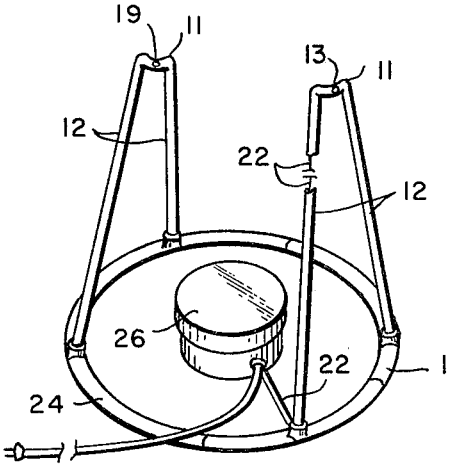
FIG. 5 shows the device of this invention using crutch type supports.

Referring to FIG. 5, the apparatus of this invention can be modified to replace a horizontal bar with crutch type supports. The structure includes two crutch supports 11, supported on legs 12. The crutch supports are provided with electrical switches 13 and 19 which function in the same manner as switches 16 and 18 described above with reference to FIG. 1. The elements 22, 24 and 26 function in the same manner as described above with reference to FIG. 1.

It is to be understood that the apparatus of this invention can be modified without changing the invention disclosed herein. For example, the platform can be provided with means for automatically raising the platform after it has stopped in the manner set forth above in order to more closely position the platform to the user and provide improved safety. Such means can comprise a switch which automatically reverses the electric motor in the platform after the platform has stopped in its lowermost position in response to weight being applied thereto. In addition, the apparatus of this invention can be provided with only one activating means within the horizontal bar rather than two. However, two activating means, one for each hand, is preferred because it provides improved safety for the overall device.

I claim:

1. A back strengthening apparatus comprising:

a. support means to support the upper body of a patient;

b. a foot platform associated with said support means;

c. means resiliently supporting said foot platform for selectively lowering said foot platform, said supporting means for sensing a predetermined amount of the patient's weight on said platform and adapted to regulate the extent said platform is lowered in response to the weight of the patient on said platform;

d. actuating means on said support means operatively connected with said platform supporting means for selectively lowering said platform; said actuating means being actuated by being grasped by the patient; whereby, when the patient is supported by said support means with a predetermined amount of the patient's weight supported by said platform and sensed by said sensing means, said actuating means is actuated by the patient causing said platform supporting means to lower said platform wherein said actuating means is adapted to regulate the extent the platform is lowered.

2. The apparatus of claim 1, wherein said actuating means and said platform supporting means are connected in series and are adapted to control an electrically powered motor for raising or lowering said platform.

3. The apparatus of claim 1, wherein said actuating means and said platform supporting means are connected in series and are adapted to control hydraulic means for raising or lowering said platform.

4. The apparatus of any one of claims 1, 2 or 3 wherein said actuating means includes a pair of spaced apart actuating means to be respectively grasped by both hands of the patient.

5. The apparatus of any one of claims 1, 2 or 3 including means for raising said platform a predetermined height after said platform is lowered to its lowermost position in response to weight on said platform.

6. The apparatus of any one of claims 1, 2 or 3 wherein the said support means comprises crutch type supports adapted to fit under the armpits of a patient standing on said platform.

7. The apparatus of any one of claims 1, 2 or 3 wherein said support means comprises a supported horizontal bar positioned above said platform.

* * * * *